US007332989B2

(12) United States Patent
Jones

(10) Patent No.: US 7,332,989 B2
(45) Date of Patent: Feb. 19, 2008

(54) SWITCH MECHANISM

(75) Inventor: Derek Jones, Gallowway (GB)

(73) Assignee: EJA Limited, Wigan (GB)

( * ) Notice: Subject to any disclaimer, the term of this patent is extended or adjusted under 35 U.S.C. 154(b) by 0 days.

(21) Appl. No.: 11/074,548

(22) Filed: Mar. 8, 2005

(65) Prior Publication Data

US 2005/0199478 A1 Sep. 15, 2005

(30) Foreign Application Priority Data

Mar. 10, 2004 (GB) ..... 0405543.0

(51) Int. Cl.
*H01H 67/02* (2006.01)

(52) U.S. Cl. ..... 335/132; 335/138; 200/43.01

(58) Field of Classification Search ..... 335/128, 335/132, 136; 200/334, 43.01, 43.19
See application file for complete search history.

(56) References Cited

U.S. PATENT DOCUMENTS 3,398,328 A * 8/1968 Piekarski ..... 361/143
4,524,251 A * 6/1985 Schulz ..... 200/43.07
5,173,673 A * 12/1992 Weigand et al. ..... 335/18
5,187,339 A * 2/1993 Lissandrin ..... 218/84
5,420,385 A * 5/1995 Cooper ..... 200/43.07
5,758,762 A 6/1998 Aulmann
5,861,786 A * 1/1999 Laveau ..... 335/132
5,898,143 A * 4/1999 Da Dalt ..... 200/17 R
5,917,394 A * 6/1999 Fuchs ..... 335/229
6,075,218 A * 6/2000 Trautmann et al. ..... 218/154
6,320,485 B1 * 11/2001 Gruner ..... 335/78

FOREIGN PATENT DOCUMENTS

EP 0345656 A 12/1989
EP 0869524 A 10/1998

* cited by examiner

*Primary Examiner*—Elvin Enad
*Assistant Examiner*—Bernard Rojas
(74) *Attorney, Agent, or Firm*—Quarles & Brady LLP; William R. Walbrun

(57) ABSTRACT

A switch mechanism has at least one set of contacts including at least one fixed contact and at least one moveable contact which is carried by an axially moveable carrier that is held by a spring-loaded detent when the contacts are closed, the carrier being released with a force to overcome the latching mechanism when opening the contacts, and a cam member with at two cam profiles that is disposed adjacent one end of the carrier and is operable to pull the axially moveable carrier towards the cam and thereby pull the at least one moveable contact into engagement with the at least one fixed contact. In one embodiment, the cam may carry a permanent magnet which when moved attracts and draws with it a permanent magnet mounted fixedly with respect to the axially moveable carrier.

20 Claims, 1 Drawing Sheet

SWITCH MECHANISM

TECHNICAL FIELD

The present invention relates to a switch mechanism, especially, but not exclusively, to a safety switch mechanism used with machine guards enclosing kinetic machinery.

BACKGROUND ART

In a known safety switch mechanism which is adapted to be fitted to an enclosure having a door, gate or protective cover, the switch assembly is adapted to switch OFF an electrical power supply when the door, gate or protective cover is opened. The known safety switch mechanism comprises a safety switch adapted to be fitted to the enclosure and an actuator adapted to be fitted to the door, gate or protective cover, and insertable into the safety switch to turn ON the electrical power when the enclosure is closed by the door, gate or protective cover.

The safety switch comprises within a housing, at least one contact set comprising at least one fixed contact, and at least one moveable contact which is carried by an axially moveable push rod spring loaded to maintain the sets of contacts apart and consequently the power supply OFF.

The axially moveable push rod is connected to a roller cam mechanism that is mounted rotatably, usually in a housing, and adapted to be rotated by the actuator when inserted through an aperture in the housing. In one known construction, the roller cam mechanism comprises a pair of roller portions axially spaced and rotatably supported on a shaft. The push rod has a cam follower pin engageable in a cam slot in each of the roller portions. Rotation of the roller cam mechanism causes the axially moveable push rod to be pushed axially to make the contacts and turn on electrical power.

The pinned connection operates in conjunction with the spring biasing to pull off the contacts when the roller cam is rotated on removal of the actuator.

The presence of the physical inter-connection of the roller cam and the axial push rod is necessary with the push on-pull off construction, but can be disadvantageous in certain failure situations. Furthermore, the fact that the contacts are pushed on and/or pulled off can give rise to problems with electronic monitoring of contact condition especially where there are multiple contact sets carried in axially spaced relation by the axially moveable push rod.

Electronic monitoring of contact condition is being increasingly employed to augment the physical safety precautions provided by such safety switches. The electronic monitoring of contact condition, serves as a double check as well as providing a means of accounting for mechanical failure of the switch mechanism. Thus, for example, the monitoring may require all contacts to make and/or break within a specified period. Ideally the period should be as short as possible to minimise down time, and to ensure a fast response time to shut down the machinery for safety purposes. It is an objective of the present invention to provide an improved switch mechanism.

SUMMARY OF THE INVENTION

Accordingly, the present invention provides a switch mechanism comprising within a housing at least one set of contacts comprising at least one fixed contact and at least one moveable contact which is carried by an axially moveable carrier spring loaded to maintain the sets of contacts apart, and an operating mechanism for the axially moveable carrier which operating mechanism is disposed adjacent one end of the carrier and is operable to pull the axially moveable carrier towards it and thereby pull the at least one moveable contact into engagement with the at least one fixed contact.

Various mechanisms suggest themselves as suitable for operating the axially moveable carrier by pulling it rather than by pushing it as is the case in the prior art, including magnetic means, pneumatic means, mechanical means and even electrical means, as well as combinations thereof.

In the case of magnetic operation, for safety switches that operate using an actuator to move an operating mechanism for the axially moveable carrier, for example using a rotary member, then the rotary member may carry a permanent magnet which when moved attracts and draws with it a permanent magnet mounted fixedly with respect to the axially moveable carrier.

Alternatively, an electromagnet may be used to pull the axially moveable carrier towards its operating mechanism. In the case of pneumatically operated means, a piston and cylinder arrangement may be employed with gas pressure serving to move a piston of the axially moveable carrier in a cylinder. In each case the operating mechanism operates against resilient biasing so that the contacts should fail to the contacts open position.

A preferred feature of the operating mechanism is that there is no physical interconnection tying the axially moveable carrier to its operating mechanism. This is advantageous in many failure situations since spring biasing of the axially moveable carrier carrying the contacts only has to move the carrier. However, in certain circumstances the possibility of using a connecting link is not to be discounted.

As far as mechanical actuation of the axially moveable carrier is concerned, the use of a rotable cam member is preferred but instead of having a pinned connection between the axially moveable carrier and the rotary cam member, a disconnected link or lever arm member is preferably employed. The cam member may have two cam profiles. These may operate individually or in combination to control making of the contacts by pulling of the axially moveable carrier toward the operating mechanism, and breaking of the contacts by pushing the axially moveable carrier away from the operating mechanism, albeit that breaking of the contacts is also carried out under the influence of the spring biasing force. A single actuator may be used to operate the two cams, or a separate actuator may be provided for each cam.

In one embodiment, a lever member is pivotally mounted to the axially moveable carrier adjacent one end thereof, and the lever member is engageable with a first cam profile of a rotary cam member. The pivotal connection is preferably intentionally constructed as the weakest link in the mechanism. This ensures that the contacts assembly fails to the OFF condition. The axially moveable member may have an abutment surface, usually its end or a shoulder spaced from the end, that engage with a second cam profile of the rotary cam member. Co-operation of the cam profile with the lever arm on rotation of the cam causes the lever to pivot with respect to the axially moveable member. Since this is constrained to move only axially, if the lever arm is engaged with an abutment/pivot point—intermediate its opposite ends, then movement of one end in one direction by contact with the cam profile will cause its other end that is connected to the axially moveable member to move in the opposite direction. Thus a pulling force can be exerted on the axially moveable member by movement of the rotary cam without having a physical interconnection with the rotary cam member.

The rotary cam member may be a single item formed with the two cam profiles, or two separate members. In the case of the latter they may be arranged to rotate simultaneously in synchronisation or independently.

Advantageously a latching mechanism is operative to hold the contact sets in the engaged position. The latching mechanism may make engagement with the axially moveable carrier or with the rotary cam member, or members, as the case may be, to hold the rotary cam member in a position corresponding to the power ON condition, ie: with the contacts pulled ON. The latching mechanism may take the form of a spring loaded plunger that is received in a detent of the axially moveable member or the rotary cam member, as the case may be.

By providing such a spring loaded latching mechanism, a resistance has to be overcome to break the contacts and this assists in ensuring that the contacts are broken quickly, ie: a greater force is applied to the mechanism and consequently the acceleration will be higher than would be the case if only a small force were required to break the contacts. This is advantageous when electronic monitoring of the contact condition is involved as it helps to avoid spurious error faults due to discrepancies in the break times of different ones of a plurality of contact sets.

We prefer an operating mechanism that is based on a rotary cam member and which is operated by an actuating member of the type used in our safety switch assemblies in order to provide an upgrade path for existing switches. However, mechanical operating mechanisms based other than on the use of a rotary cam are not excluded from the scope of the present invention. Thus any other mechanical operating mechanism may be employed that is able to exert a pulling force directly or indirectly on the moveable contact carrier.

The prior art has been discussed in relation to a safety switch assembly for use on an enclosure for kinetic machinery. However, the switch mechanism of the present invention is not limited to such applications. It is applicable to any switching situation that utilises an axially moveable carrier for making and breaking electrical contacts.

BRIEF DESCRIPTION OF THE DRAWINGS

The present invention will now be described further hereinafter, by way of example only, with reference to the accompanying drawings, in which:—

DESCRIPTION OF A PREFERRED EMBODIMENT

Figures 1, 2, 3:
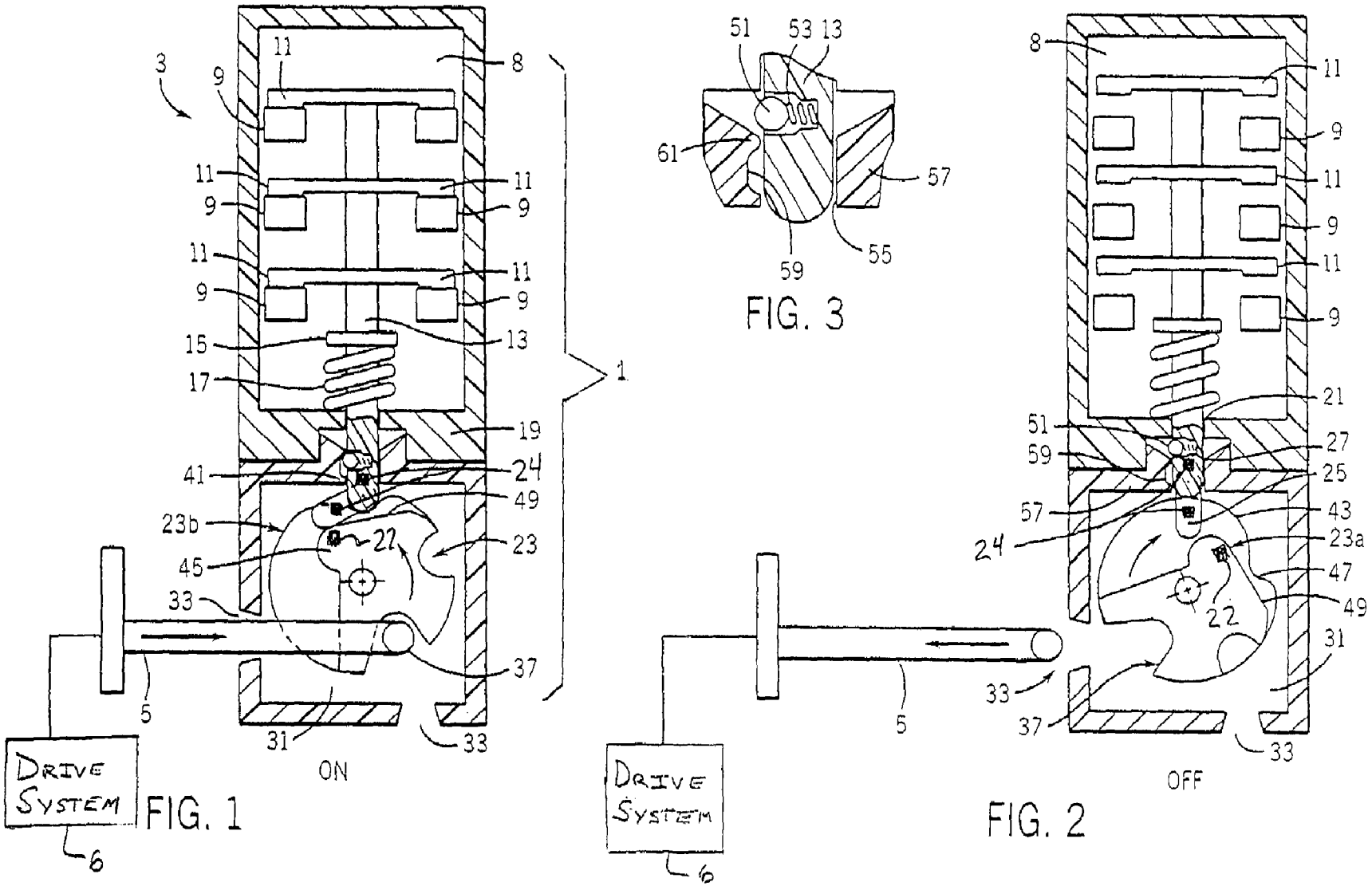
FIG. 1 is a schematic sectional view of a switch mechanism embodying the invention showing the contacts in a closed position.
FIG. 2 is a schematic sectional view of the embodiment of FIG. 1 showing the contacts in the open position.
FIG. 3 is a detailed view, to an enlarged scale, of a latching mechanism for the axially movable carrier, illustrated in the position of FIG. 2.

The present invention is described in relation to a safety switch assembly 1 having a safety switch 3 that, in use, is secured to an enclosure (not illustrated) having an openable closure, and which has an actuator 5 driven by a drive system 6 for securement of the openable closure for operating the safety switch. The drive system 6 may operate by way of any of a variety of known drive mechanisms. For example, the driving mechanism for the drive system may include magnetism, pneumatic pressure, mechanical actuation, or electrical actuation. That is, the drive system 6 may include a mechanically, electrically, or magnetically controlled switch, a piston and cylinder system that is actuated by way of gas or liguid pressure changes, or any of a variety of additional systems for moving the actuator 5 as described below. The safety switch 3 comprises a housing 7 having a chamber 8 accommodating an electrical contact arrangement comprising fixed contacts 9 and moveable contacts 11 and hereinafter referred to the switch contact chamber 8. In the illustrated embodiment there are three sets of contacts. The moveable contacts 11 are carried on a common contact stem 13 which is mounted for rectilinear movement. The stem 13 carries a collar 15 fixedly mounted thereto and a coil spring 17 acts between the collar 15 and an end wall 19 of the switch contact chamber. The stem passes through an aperture 21 in the end wall 19.

As will be seen from FIG. 2, the spring 17 operates to bias the stem and hence the moveable contacts 11 carried therewith to an open position, usually corresponding to a power OFF condition. In order to move the contact sets to the closed position, as illustrated in FIG. 1, the contact carrier 13 has to be moved against the resistance of the spring bias.

In the illustrated embodiment this is achieved using a rotary cam member 23 and lever member 25. In accordance with one configuration, the lever member 25 is connected to an end 27 of the stem 13 by a pivot connection 26 and the lever member 25 is co-operable with a first cam profile 23*a* of the rotary cam member. However, it is also contemplated that the rotary cam member 23 may carry a permanent magnet 22 that when moved attracts and draws with it a permanent magnet 24 mounted to the axially moveable carrier, for example, on the lever member 23. The lever member 25 is also co-operable with an abutment surface 41 of end wall 19. The rotary cam member 23 is accommodated within a cam chamber 31 forming part of the housing 7, and the cam chamber has apertures 33,35 to receive the switch actuator 3. In the example these apertures 33,35 are disposed in planes set 90° apart so that the rotary cam member 23 can be operated by inserting the actuator into any one of the apertures 33,35. In the illustrated embodiment it is shown in relation to aperture 33. In the illustrated embodiment the rotary cam member has a second cam profile 23*b* that is contactable directly by the end 27 axially moveable member. The second cam profile 23*b* of rotary cam member 23 has an external profile that restricts movement of the stem 13. Its function is described further hereinafter. A latching mechanism for the stem 13 is described in further detail with reference to FIG. 3. In that regard stem 13 accommodates a spring loaded ball 51 that is urged in a direction normal to the axis of stem 13 by spring 53 to project from the side of the stem. The stem slides in a bore 55 of an end cap 57 accommodating the rotary cam member 23. The bore has a recess 59 that is aligned with the ball 51 in the ON position of the contact carrier see FIG. 1. A shoulder 61 of the recess 59 acts on the ball when the stem is urged in its OFF direction. The force of spring 53 is overcome by the force of spring 17, but the presence of the latching means, when provided, ensures that the contacts are broken quickly when the resistance to movement is overcome.

Starting from the contacts open position—see FIG. 2—insertion of the actuator 5 causes the rotary cam member 23 to rotate anticlockwise as viewed in the illustration by engagement of an end of the actuator 5 with recess 37 of the rotary cam member as is well known in the art in relation to cam operated safety switches. Other safety means, not illustrated, may be provided to inhibit rotation of the rotary cam member other than by insertion of the correctly shaped actuator 5 as is also well known in the art and not described in further detail as it is not pertinent to the present invention.

Cam profile 23*b* is initially in contact with the end of the valve stem over arc 43 holding up the stem and holding the contacts open. As rotary cam member rotates anticlockwise, a protrusion 45 on cam profile 23*a* contacts the lever member 25 causing it to pivot. With continued rotation a depression 47 in cam profile 23*b* opens a gap beneath the end of the stem 13, whilst a part 49 of cam profile 23*a* acts on the lever member 25 causing its free end to pivot. However, because it is attached to the stem and, it is constrained between the cam profile 49 and the abutment surface 41, continued rotation of the rotary cam member causes the lever member to pivot about the abutment surface causing the stem 13 to be pulled downwardly against the spring force so that the contacts are brought into engagement as shown in FIG. 1. With the rotary cam member held in this position, the contact remains closed. The aforesaid latching mechanism, where provided, is also brought into effect.

When the actuator 5 is withcirawn, the rotary cam member moves in the clockwise direction as viewed in the illustration and once the lever member is released, the cam profile 43 and the spring act 17 to overcome the resistance of the latching mechanism, where provided, and move the stem 13 and open the sets of contacts 9,11.

With the above-described embodiment, there is no physical connection between the stem and the rotary cam member. This is advantageous and means that the speed of contact separation need not be limited to cam rotation speed and can be determined by the spring force acting on the stem.

The invention claimed is:

1. A switch mechanism comprising:

a housing;

at least one set of contacts at least partially arranged in the housing and comprising at least one fixed contact and at least one moveable contact which is carried by an axially moveable carrier spring loaded to maintain contacts apart;

a rotary member disposed adjacent one end of the carrier and being operable to pull the axially moveable carrier towards the rotary member and thereby pull the at least one moveable contact into engagement with the at least one fixed contact; and wherein the moveable carrier and the rotary member are not connected.

2. A switch mechanism as claimed in claim 1 in which the rotary member operates in response to at least one of a magnetism, pneumatic pressure, mechanical actuation and electrical actuation.

3. A switch mechanism comprising within a housing at least one set of contacts comprising at least one fixed contact and at least one moveable contact which is carried by an axially moveable carrier spring loaded to maintain contacts apart, and an operating mechanism for the axially moveable carrier, said operating mechanism being disposed adjacent one end of the carrier and being operable to pull the axially moveable carrier towards the operating mechanism and thereby pull the at least one moveable contact into engagement with the at least one fixed contact;

in which the operating mechanism operates in response to at least one of a magnetism, pneumatic pressure, mechanical actuation and electrical actuation; and in which the operating mechanism comprises a rotary member that is rotated by an actuator and in which the rotary member carries a permanent magnet which when moved attracts and draws with it a permanent magnet mounted fixedly with respect to the axially moveable carrier.

4. A switch mechanism as claimed in claim 2 in which an electromagnet is used to pull the axially moveable carrier towards its rotary member.

5. A switch mechanism as claimed in claim 2 in which a piston and cylinder arrangement is employed and gas pressure serves to move the piston of the axially moveable carrier.

6. A switch mechanism as claimed in claim 1 in which the rotary member operates against resilient biasing which acts to urge the contacts to the open position.

7. A switch mechanism as claimed in claim 1 in which the rotary member comprises a rotatable cam member and a disconnected link or lever arm member carried by the axially movable carrier and co-operable with the rotary cam member.

8. A switch mechanism as claimed in claim 7 in which the cam member has two cam profiles.

9. A switch mechanism as claimed in claim 8 in which the two cam profiles operate individually to control making of the contacts by pulling of the axially moveable carrier toward the rotary member, and breaking of the contacts by pushing the axially moveable carrier away from the rotary member.

10. A switch mechanism as claimed in claim 8 in which the two cam profiles operate in combination.

11. A switch mechanism as claimed in claim 8 and further comprising a single actuator to operate the two cam profiles.

12. A switch mechanism as claimed in claim 8 and further comprising a separate actuator for each cam profile.

13. A switch mechanism as claimed in claim 7 in which breaking of the contacts is carried out under the influence of a spring biasing force.

14. A switch mechanism comprising within a housing at least one set of contacts comprising at least one fixed contact and at least one moveable contact which is carried by an axially moveable carrier spring loaded to maintain contacts apart, and an operating mechanism for the axially moveable carrier, said operating mechanism being disposed adjacent one end of the carrier and being operable to pull the axially moveable carrier towards the operating mechanism and thereby pull the at least one moveable contact into engagement with the at least one fixed contact;

in which the operating mechanism comprises a rotatable cam member and a disconnected link or lever arm member carried by the axially movable carrier and co-operable with the rotary cam member;

in which the cam member has two cam profiles; and in which the lever member is pivotally mounted to the axially moveable carrier adjacent one end thereof, and the lever member is engageable with a first cam profile of a rotary cam member.

15. A switch mechanism as claimed in claim 8 in which the axially moveable member has an abutment surface that engages with a second cam profile of the rotary cam member.

16. A switch mechanism as claimed in claim 7 and further comprising a latching mechanism that is operative to hold the contact sets in the engaged position.

17. A switch mechanism as claimed in claim 16 in which the latching mechanism makes engagement with the axially moveable carrier.

18. A switch mechanism as claimed in claim 16 in which the latching mechanism makes engagement with the rotary cam member to hold the rotary cam member in a position corresponding to the power ON condition.

19. A switch mechanism as claimed in claim 17 in which the latching mechanism comprises a spring loaded plunger that is received in a detent of the axially moveable member.

20. A switch mechanism as claimed in claim 17 in which the latching mechanism comprises a spring loaded plunger that is received in a detent of the rotary cam member.

* * * * *